US007854215B2

(12) United States Patent
Rozario et al.

(10) Patent No.: US 7,854,215 B2
(45) Date of Patent: Dec. 21, 2010

(54) VALVE TRAIN WITH OVERLOAD FEATURES

(75) Inventors: Frederick J. Rozario, Fenton, MI (US); James B. Hicks, Shelby Township, MI (US); William C. Albertson, Clinton Township, MI (US); Gary J. Patterson, Utica, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 677 days.

(21) Appl. No.: 11/769,858

(22) Filed: Jun. 28, 2007

(65) Prior Publication Data

US 2009/0000579 A1 Jan. 1, 2009

(51) Int. Cl.
*F01L 1/18* (2006.01)

(52) U.S. Cl. ..... 123/90.39; 123/90.61; 29/888.2; 74/559

(58) Field of Classification Search ..... 123/90.39, 123/90.44, 90.61, 90.62, 90.63, 90.64; 29/888.2; 74/559, 567, 569
See application file for complete search history.

(56) References Cited

U.S. PATENT DOCUMENTS 2,962,011 A * 11/1960 Rosenberger ..... 123/90.43
3,009,450 A * 11/1961 Engemann ..... 123/90.43
4,505,236 A * 3/1985 Nakamura ..... 123/90.27
5,791,307 A 8/1998 Helmin
5,864,948 A * 2/1999 Jesel ..... 29/888.011
6,557,518 B1 5/2003 Albertson et al.
6,584,942 B1 7/2003 Albertson et al.
6,584,951 B1 7/2003 Patel et al.
6,681,734 B2 1/2004 Albertson
6,782,855 B1 8/2004 Albertson et al.
6,978,752 B2 12/2005 Albertson et al.
7,111,597 B2 9/2006 Manole et al.
7,484,484 B2 2/2009 Frincke et al.
7,503,296 B2 3/2009 Rozario et al.

* cited by examiner

*Primary Examiner*—Ching Chang

(57) ABSTRACT

A valve train for use in an engine is provided. The valve train includes a rocker arm assembly having a valve side arm and a cam side arm. A valve is coupled to the engine and is in contact with the valve side arm. A pushrod is reciprocatable by a camshaft and is in contact with the cam side arm. An overload feature is located on at least one of the rocker arm assembly or the pushrod. The overload feature has a reduced cross-sectional area calibrated to activate at a predefined load.

18 Claims, 4 Drawing Sheets

SECTION 3B-3B

VALVE TRAIN WITH OVERLOAD FEATURES

FIELD

The present disclosure relates to valve trains, and more particularly to a valve train having overload features.

BACKGROUND

The statements in this section merely provide background information related to the present disclosure and may or may not constitute prior art.

Internal combustion engines typically include an arrangement of pistons and cylinders located within an engine block. In a four stroke engine, each cylinder has at least two valves. These valves control the flow of air to the combustion cylinders and allow for venting of combustion exhaust gasses. A simple valve arrangement includes an intake valve and an exhaust valve, each actuated by a valve train. The valve train typically includes a camshaft with cam followers that actuate respective pushrods and rocker assemblies. The rocker assemblies in turn actuate respective intake and exhaust valves.

Though unlikely, it is possible that during operation of the valve train, a failure may occur in one of the various components. One such failure could include a mistimed event. A mistimed event may occur when the intake valve in an engine employing cylinder deactivation is inadvertently reactivated before the activation of the exhaust valve. In this scenario, the intake valve is forced open against combustion and exhaust gasses under large amounts of pressure. These gasses may create as much as 19.5 kN of force and cause failures in expensive and/or difficult to replace components within the valve train or engine. Accordingly, it is desirable that the valve train is designed to fail at controlled locations in order to prevent more extensive damage to the valve train and/or engine during a mistiming event

SUMMARY

In one aspect of the present invention, a valve train for use in an engine is provided. The valve train includes a rocker arm assembly having a valve side arm and a cam side arm. A valve is coupled to the engine and is in contact with the valve side arm. A pushrod is reciprocatable by a camshaft and is in contact with the cam side arm. An overload feature is located on at least one of either the rocker arm assembly or the pushrod. The overload feature has a reduced cross-sectional area calibrated to activate at a predefined load.

In another aspect of the present invention, the overload feature is located on the pushrod.

In yet another aspect of the present invention, the pushrod includes a first wall portion with a first thickness and a second wall portion within the overload feature with a second thickness, and wherein the second thickness is less than the first thickness.

In yet another aspect of the present invention, the second wall portion is located proximate to an end of the pushrod that contacts the cam side lever arm.

In yet another aspect of the present invention, the rocker arm assembly includes an annular extension that defines a bore, and the overload feature includes a first slot and a second slot located on the annular extension.

In yet another aspect of the present invention, the first slot and the second slot are located on opposite sides of the annular extension.

In yet another aspect of the present invention, the first slot reduces a cross-sectional area through the annular extension a first amount and the second slot reduces a cross-sectional area through the annular extension a second amount that is different than the first amount.

In yet another aspect of the present invention, the rocker arm assembly further includes a bolt that couples the rocker arm assembly to the engine, and wherein the overload feature is located on the bolt.

In yet another aspect of the present invention, the bolt includes a cylindrical shaft having a portion with a first cross-sectional area and a portion within the overload feature and having a second cross-sectional area less than the first cross-sectional area.

In still another aspect of the present invention, a rocker arm assembly for use in a valve train having a pushrod and a valve is provided. The rocker arm assembly includes a rocker body, a valve side arm extending from the rocker body and in contact with the valve, and a cam side arm extending from the rocker body opposite the valve side arm and in contact with the pushrod. A slot is located in the cam side arm and has a size calibrated such that the cam side arm will fail at a predefined load.

In yet another aspect of the present invention, the slot is circular.

In yet another aspect of the present invention, the circular slot is located in a first surface of the rocker arm and the pushrod contacts a second surface of the rocker arm opposite the first surface.

In yet another aspect of the present invention, the circular slot is aligned with the pushrod.

In yet another aspect of the present invention, the rocker arm assembly further includes a pair of side slots extending from the circular slot.

In yet another aspect of the present invention, the side slots extend from opposite sides of the circular slot along the length of the second rocker arm.

In yet another aspect of the present invention, the rocker arm assembly further includes a fluid port formed in the top surface of the second rocker arm and located within the circular slot.

In yet another aspect of the present invention, a failure occurs when the pushrod pushes through the circular slot of the second rocker arm.

In yet another aspect of the present invention, the second rocker arm grips the pushrod if the pushrod pushes through the circular slot in the second rocker arm during a failure.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
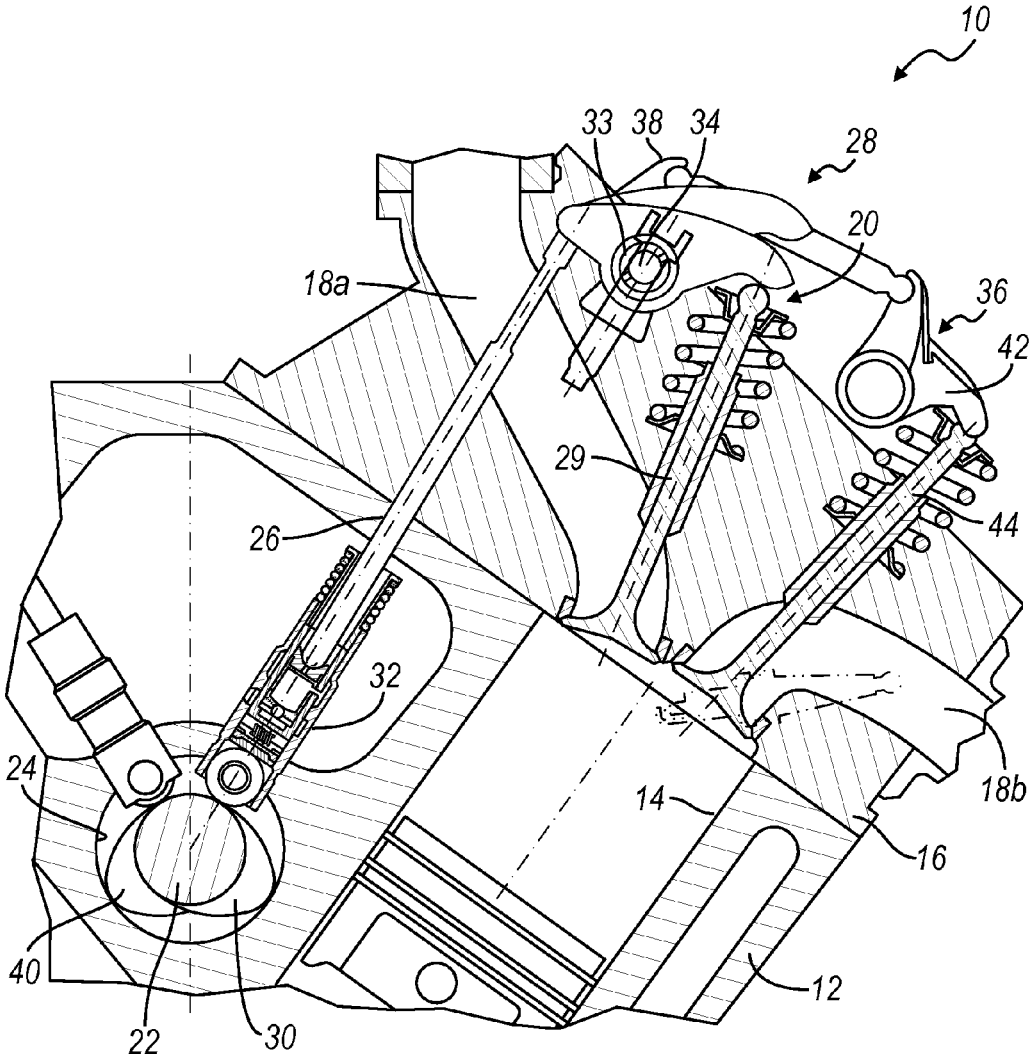
FIG. 1 is a side elevational view of a valve train according to the principles of the present invention illustrated in an exemplary internal combustion engine.

Referring now to FIG. 1, a portion of an internal combustion engine is illustrated and generally designated by the reference number 10. The internal combustion engine 10 includes an engine block 12 which defines a plurality of cylinders 14, only one of which is illustrated in FIG. 1. A cylinder head 16 is secured to the top of the engine block 12 and defines at least one inlet passageway 18A and one exhaust passageway 18B for each cylinder 14.

The internal combustion engine 10 also includes a valve train 20 according to the principles of the present invention. The valve train 20 includes a camshaft 22 which is received and supported for rotation in a bore 24 within the engine block 12. In the particular example provided, the cylinders 14 are arranged in a V-type arrangement and the camshaft 22 is located at the bottom of the "V". However, it should be appreciated that various other cylinder 14 and camshaft 22 arrangements may be employed with the present invention.

The valve train 20 also includes a pushrod 26, a rocker arm assembly 28, and at least one inlet valve 29. The camshaft 22 includes an inlet cam 30 that engages a hydraulic roller lifter 32 at an end of the pushrod 26. The pushrod 26 is coupled at an opposite end thereof to the rocker assembly 28. The rocker assembly 28 is in turn coupled to the inlet valve 29. The inlet valve 29 is biased by a biasing member 31, illustrated as a spring in the particular example provided.

During operation of the valve train 20, rotation of the camshaft 22 and the inlet cam 30 reciprocates the hydraulic roller lifter 32 and the pushrod 26. The pushrod 26 then actuates the rocker assembly 28 such that the rocker assembly 28 oscillates on a supporting shaft 33 about a pivot axis 34. The pivot axis 34 is parallel to the axis of the camshaft 24. As the rocker assembly 28 is actuated by the reciprocating pushrod 26, the rocker assembly 28 opens and closes the inlet valve 29. The inlet valve 29 is in communication with the cylinder 14 and allows air intake into the cylinder 14 as the camshaft 22 rotates and the pushrod 26 reciprocates.

An exhaust valve train 36 is also illustrated with the engine 12. The exhaust valve train 36 includes an exhaust pushrod 38 (the top of which is shown) that is reciprocated by an exhaust cam 40 on the camshaft 22. The exhaust pushrod 38 in turn oscillates an exhaust rocker arm 42, which reciprocates an exhaust valve 44. The exhaust valve train 36 operates in a manner similar to the valve train 20, though the opening and closing of the exhaust valve 44 is out of synch with the opening and closing of the pair of inlet valves 29.

Figure 2:
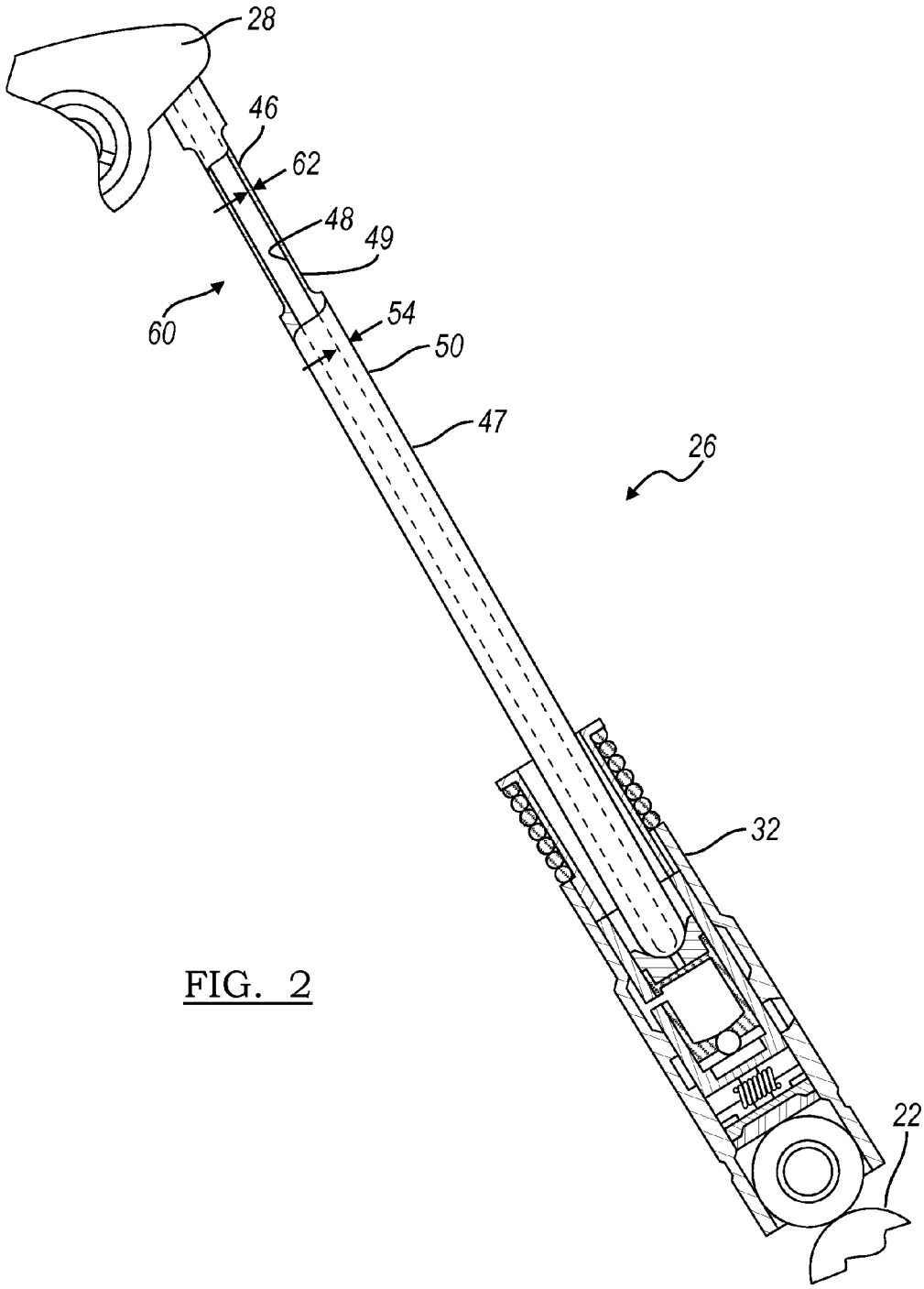
FIG. 2 is an enlarged side view of a pushrod within the valve train of the present invention.

With reference to FIG. 2, an enlarged view of the pushrod 26 used in the valve train 20 of the present invention is illustrated. As noted above, the pushrod 26 is coupled to the rocker arm assembly 28 at one end and to the hydraulic roller lifter 32 at an opposite end. The pushrod 26 is generally cylindrical and includes a wall 46. The wall 46 includes an inner surface 48 and an outer surface 50. The inner surface 48 of the wall 46 defines an inner cavity 52 used to allow hydraulic fluid to flow from the hydraulic roller lifter 32 to the rocker arm assembly 28, though it should be appreciated that the pushrod 26 may be solid without departing from the scope of the present invention. The wall 46 has a first thickness, indicated by reference number 54, throughout a first wall portion 47.

The pushrod 26 also includes an overload feature 60. The overload feature 60 includes a reduction in the thickness of the wall 46 of the pushrod 26 along a second wall portion 49 of the pushrod 26. Accordingly, the wall 46 of the overload feature 60 has a second thickness, indicated by reference number 62, through the second wall portion 49 that is less than the first thickness 54. In this way, the cross-sectional area through the overload feature 60 is less than the cross-sectional area through the remainder of the pushrod 26. In the particular example provided, the thickness of the wall 46 is reduced through the overload feature 60 by removing material from the outer surface 50 of the wall 46. Alternatively, the thickness of the wall 46 may be reduced through the overload feature 60 by removing material from the inner surface 48 of the wall 46. The overload feature 50 acts as a "fuse" for the valve train 20. More specifically, the reduced cross-sectional area of the wall 46 at the overload feature 60 (the second wall portion 49) has a compressive strength less than that of the wall 46 along the rest of the pushrod 26 (the first wall portion 47). Accordingly, if the pushrod 26 is subjected to a predefined compressive load or force that exceeds the strength of the pushrod 26 through the overload feature 60, then the overload feature 60 activates and the pushrod 26 will separate or bend at a point within the overload feature 60. The load or force at the overload feature 60 that results in activation may be calibrated by adjusting the cross-sectional area of the wall 46 at the overload feature 60. The overload feature 60 is preferably located proximate to the rocker arm assembly 28 such that during activation of the overload feature 60, the pushrod 26 may be extracted from the engine 10 with minimal difficulty.

Figure 3A:
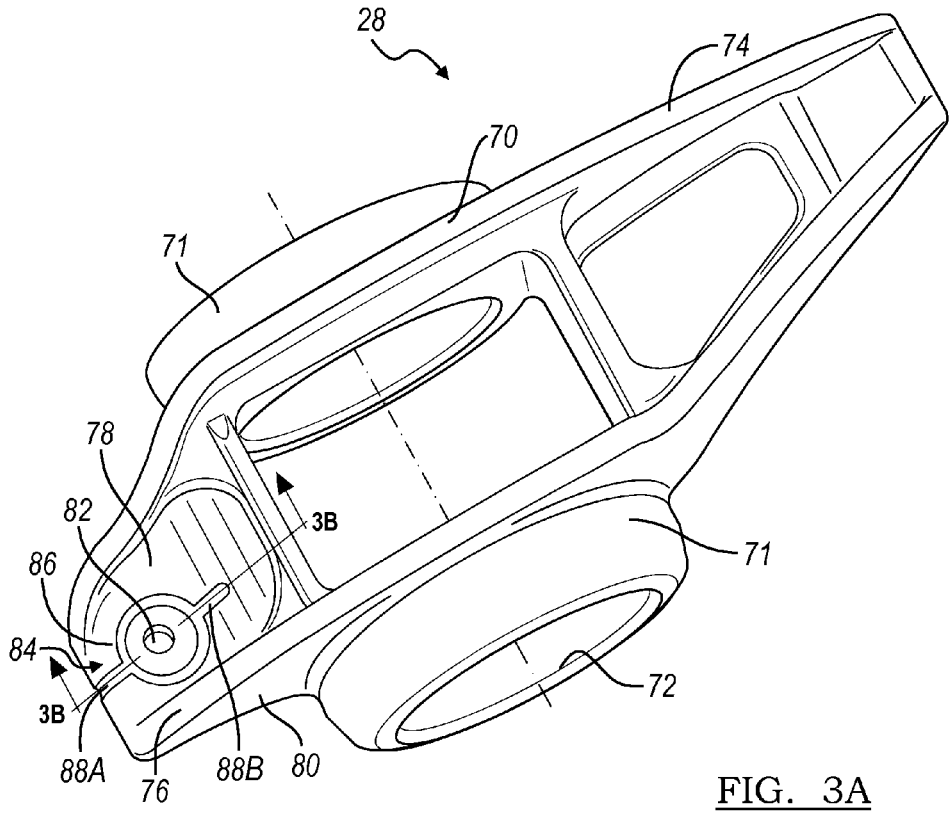
FIG. 3A is an isometric view of a rocker arm assembly within the valve train of the present invention.
Figure 3B:
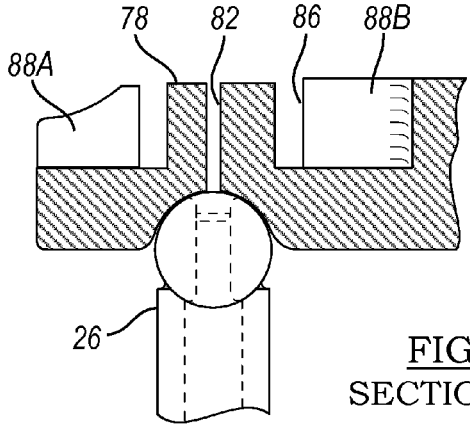
FIG. 3B is a cross-sectional view of a portion of the rocker arm assembly of FIG. 3A taken in the direction of arrows 3B-3B.

Turning now to FIGS. 3A and 3B, an enlarged view of the rocker arm assembly 28 used in the valve train 20 is provided. The rocker arm assembly 28 includes a rocker body 70 having a pair of annular extensions 71 that define a cylindrical bore 72. The cylindrical bore 72 is sized to receive the supporting shaft 33 therein (FIG. 1). Two lever arms extend from the rocker body 70 and include a first or valve side lever arm 74 and a second or cam side lever arm 76. The valve side lever arm 74 and the cam side lever arm 76 extend from opposite sides of the rocker body 70. The valve side lever arm 74 is coupled to the intake valve 29 (FIG. 1). The cam side lever arm 76 includes a top surface 78 and a bottom surface 80. The pushrod 26 (FIG. 1) is connected to the cam side lever arm 76 at the bottom surface 80. A fluid port 82 extends through the cam side lever arm 76 and cooperates with the pushrod 26 to transfer hydraulic fluid, such as oil, from the hydraulic roller lifter 32 through the pushrod 26 to the rocker arm assembly 28.

The rocker arm assembly 28 further includes an overload feature 84 located on the cam side lever arm 76. The overload feature 84 includes a circular slot 86 formed in the top surface 78 on the cam side lever arm 76. The circular slot 86 encircles the fluid port 82 and is positioned such that the circular slot 86 is approximately aligned with the end of the pushrod 26 on the bottom surface 80 of the cam side lever arm 76. A pair of side slots 88A and 88B extend out from the circular slot 86 on opposite sides. The side slots 88A and 88B are preferably positioned such that they extend along the length of the cam side lever arm 76. In the particular example provided, the side slot 88A extends to an end or tip of the cam side lever arm 76 and the side slot 88B extends towards the rocker body 70. The overload feature 84 acts as a "fuse" for the valve train 20.

More specifically, the slots 86, 88A, and 88B cooperate to reduce the cross-sectional area of the cam side lever arm 76 thereby reducing the strength of the cam side lever arm 76 through that cross-sectional area. Accordingly, if the pushrod 26 is subjected to a predefined compressive load that exceeds the strength of the cam side lever arm 76 at the overload feature 84, then the overload feature 84 will activate and the pushrod 26 will punch through the cam side lever arm 76 near the circular slot 86. The cam side lever arm 76 will also preferably separate or bend between the side slot 88B and the rocker body 70. During such an activation, the cam side lever arm 76 will grip the pushrod 26 as the pushrod 26 pushes through the cam side lever arm 76, thereby preventing the pushrod 26 from coming free within the engine 10. The depths or sizes of the slots 86, 88A, and 88B into the cam side lever arm 76 may be sized such that the pushrod 26 will push through the cam side lever arm 76 at a calibrated, predefined load or force.

Figure 4:
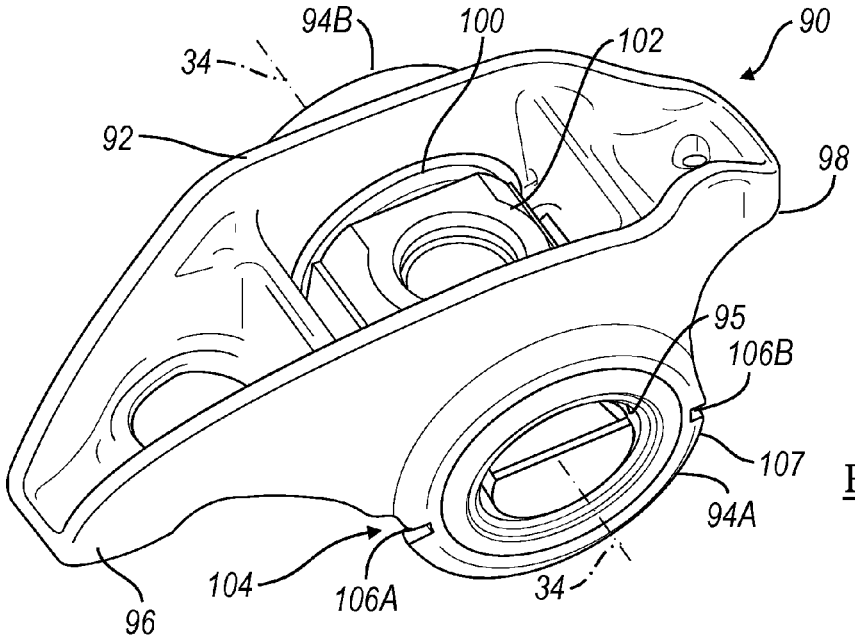
FIG. 4 is an isometric view of another rocker arm assembly according to the principles of the present invention.

With reference to FIG. 4, an alternate embodiment of the rocker arm assembly 28 shown in FIG. 3 is illustrated and indicated by reference number 90. The rocker arm assembly 90 is substantially similar to the rocker arm assembly 28 and includes a rocker body 92, a pair of annular extensions 94A and 94B that define a cylindrical bore 95, a valve side lever arm 96, and a cam side lever arm 98. The rocker arm assembly 90 is further illustrated with an exemplary bearing assembly 100 and an exemplary support shaft 102 located within the cylindrical bore 95.

The rocker arm assembly 90 also includes an overload feature 104 located on the annular extension 94A. It should be appreciated that the overload feature 104 may alternatively be located on the annular extension 94B or on both annular extensions 94A and 94B without departing from the scope of the present invention. The overload feature 104 includes a first slot 106A and a second slot 106B. The slots 106A and 106B are located on opposite sides of the annular extension 94A. Each slot 106A and 106B extend from an outer edge 107 of the annular extension 94A radially inward towards the pivot axis 34. The slots 106A and 106B reduce a wall thickness of the annular extension 94A a predefined amount. The overload feature 104 acts as a "fuse" for the valve train 20. More specifically, the reduced cross-sectional area of the annular extension 94A at the overload feature 104 has a strength less than that of the rest of the annular extension 94A. Accordingly, if during a mistiming event the pushrod 26 subjects the rocker arm assembly 90 to a load or force that exceeds the strength of the annular extension 94A through the overload feature 104, then the overload feature 104 will activate and accordingly the annular extension 94A will separate or bend at a point within the overload feature 104. The amount of load or force that results in activation at the overload feature 104 may be calibrated by adjusting the depths or sizes of the slots 106A and 106B which in turn change the cross-sectional area through the annular extension 94A and therefore the strength through that cross-sectional area. In a preferred embodiment, the slots 106A and 106B have different depths and sizes such that the first slot 106A reduces the cross-sectional area or wall thickness of the annular extension 94A a first amount and the second slot 106B reduces the cross-sectional area or wall thickness of the annular extension 94A a second amount that is different than the first amount. Accordingly, the annular extension 94A will separate at one of the slots 106A or 106B before separating at the other. Therefore, the annular extension 94A will stay attached at whichever of the cross-sectional areas through the slots 106A or 106B has greater strength. This feature prevents a portion of the annular extension 94A from coming completely free of the rocker arm assembly 28 and moving loose within the engine 10.

Figure 5:
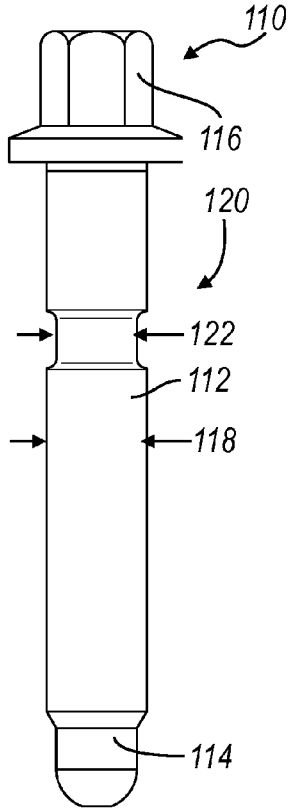
FIG. 5 is a side view of a bolt used in the rocker arm assembly according to the principles of the present invention.

Turning now to FIG. 5, a center bolt used in the rocker arm assemblies 28 and 90 in FIGS. 3 and 4 is generally indicated by reference number 110. The center bolt 110 extends through the center shaft 102 (FIG. 4) and couples the rocker arm assemblies 28 and 90 to the engine 10 (FIG. 1). The center bolt 110 includes a cylindrical shaft 112 extending between a narrowed tip portion 114 and a head portion 116. The cylindrical shaft 112 has a first diameter, indicated by reference number 118.

The center bolt 110 further includes an overload feature 120 located on the cylindrical shaft 112. The overload feature 120 includes a reduction in the diameter of the cylindrical shaft 112. Accordingly, the cylindrical shaft 112 through the overload feature 120 has a second diameter, indicated by reference number 122, that is less than the first diameter 118 such that the cross-sectional area through the overload feature 120 is less than the cross-sectional area through the remainder of the cylindrical shaft 112. The overload feature 120 acts as a "fuse" for the valve train 20. More specifically, the reduced cross-sectional area of the cylindrical shaft 112 at the overload feature 120 has a strength less than that along the rest of the cylindrical shaft 112. Accordingly, if during a mistiming event the pushrod 26 subjects the rocker arm assembly 90 and therefore the center bolt 110 to a load or force that exceeds the strength of the center bolt 110 through the overload feature 120, then the overload feature is activated and accordingly the center bolt 110 will break or separate at a point within the overload feature 120. The amount of load or force that results in activation at the overload feature 120 may be calibrated by adjusting the cross-sectional area of the cylindrical shaft 112 at the overload feature 120.

Preferably, only one of the overload features 60, 84, 104, and 120 described throughout the several views will be employed in any given application. However, it should be appreciated that any number or combination may be employed without departing from the scope of the present invention.

The description of the invention is merely exemplary in nature and variations that do not depart from the gist of the invention are intended to be within the scope of the invention. Such variations are not to be regarded as a departure from the spirit and scope of the invention.

What is claimed is:

1. A valve train for use in an engine comprising:

a pushrod having a first end in contact with a camshaft and a second end, wherein the pushrod has a pushrod cross-sectional area;

a rocker arm assembly having a first arm in contact with the second end of the pushrod and a second arm, wherein the rocker arm has a rocker arm cross-sectional area;

a valve actuatable by the second arm of the rocker arm assembly; and an overload feature located on at least one of the rocker arm assembly and the pushrod, wherein the overload feature includes reducing one of the pushrod cross-sectional area and the rocker arm cross-sectional area such that the overload feature is calibrated to activate at a predefined load.

2. The valve train of claim 1 wherein the overload feature is located on the pushrod.

3. The valve train of claim 2 wherein the pushrod includes a first wall portion with a first thickness and the overload feature includes a second wall portion with a second thickness, and wherein the second thickness is less than the first thickness.

4. The valve train of claim 3 wherein the second wall portion is located proximate to the second end of the pushrod that contacts the first arm of the rocker arm assembly.

5. The valve train of claim 1 wherein the rocker arm assembly includes an annular extension, and the overload feature is disposed on the annular extension and includes a first slot and a second slot that reduce a wall thickness of the annular extension.

6. The valve train of claim 5 wherein the first slot and the second slot of the overload feature are located on opposite sides of the annular extension.

7. The valve train of claim 6 wherein the first slot reduces the wall thickness of the annular extension an amount different than an amount reduced by the second slot.

8. The valve train of claim 1 wherein the rocker arm assembly further includes a bolt that couples the rocker arm assembly to the engine, and wherein a second overload feature is located on the bolt.

9. The valve train of claim 8 wherein the bolt includes a cylindrical shaft having a portion with a first cross-sectional area and a portion within the overload feature and having a second cross-sectional area less than the first cross-sectional area.

10. A rocker arm assembly for use in a valve train having a pushrod and a valve, the rocker arm assembly comprising:

a rocker body;

a first arm extending from the rocker body and in contact with the valve;

a second arm extending from the rocker body opposite the first arm, the second arm in contact with the pushrod; and a slot located in the second arm having a size calibrated such that the second arm will separate at a predefined load.

11. The rocker arm assembly of claim 10 wherein the slot is circular.

12. The rocker arm assembly of claim 11 wherein the circular slot is located in a first surface of the second arm and the pushrod contacts a second surface of the second arm opposite the first surface.

13. The rocker arm assembly of claim 12 wherein the circular slot is aligned with the pushrod.

14. The rocker arm assembly of claim 13 further comprising a pair of side slots extending from the circular slot.

15. The rocker arm assembly of claim 14 wherein the side slots extend from opposite sides of the circular slot along the length of the second arm.

16. The rocker arm assembly of claim 15 further comprising a fluid port formed in the top surface of the second arm and located within the circular slot.

17. The rocker arm assembly of claim 16 wherein the second arm separates when the pushrod pushes through the circular slot of the second arm.

18. The rocker arm assembly of claim 17 wherein the second arm grips the pushrod if the pushrod pushes through the circular slot in the second arm.

* * * * *